United States Patent [19]

Malik

[11] Patent Number: 4,627,931

[45] Date of Patent: Dec. 9, 1986

[54] METHOD AND COMPOSITIONS FOR HARD SURFACE CLEANING

[75] Inventor: Arshad H. Malik, Decatur, Ill.

[73] Assignee: A. E. Staley Manufacturing Company, Decatur, Ill.

[21] Appl. No.: 696,688

[22] Filed: Jan. 29, 1985

[51] Int. Cl.[4] ..... C11D 1/722; C11D 3/33; C11D 3/43

[52] U.S. Cl. ..... 252/153; 252/139; 252/170; 252/171; 252/174.17; 252/174.21; 252/174.22; 252/DIG. 1; 252/DIG. 14; 252/546

[58] Field of Search ..... 252/174.17, 174.21, 252/174.22, 135, 170, 171, 139, DIG. 14, DIG. 1, 546, 153

[56] References Cited

U.S. PATENT DOCUMENTS

| | | | |
|---|---|---|---|
| 3,308,067 | 3/1967 | Diehl | 252/174.24 |
| 3,591,510 | 7/1971 | Zenk | 252/525 |
| 3,721,633 | 3/1973 | Ranauto | 252/527 |
| 3,723,322 | 3/1973 | Diehl | 252/174.18 |
| 3,882,038 | 5/1975 | Clayton et al. | 252/164 |
| 4,144,226 | 3/1979 | Crutchfield | 528/231 |
| 4,147,652 | 4/1979 | Kaniecki | 252/156 |
| 4,152,305 | 5/1979 | Berghausen | 252/523 |
| 4,483,779 | 11/1984 | Llenado et al. | 252/135 |
| 4,493,773 | 1/1985 | Cook et al. | 252/8.8 |
| 4,540,505 | 9/1985 | Frazier | 252/106 |

FOREIGN PATENT DOCUMENTS

| | | |
|---|---|---|
| 789856 | 10/1973 | Belgium . |
| 70074 | 1/1983 | European Pat. Off. . |
| 70075 | 1/1983 | European Pat. Off. . |
| 70076 | 1/1983 | European Pat. Off. . |
| 70077 | 1/1983 | European Pat. Off. . |
| 75994 | 4/1983 | European Pat. Off. . |
| 75995 | 4/1983 | European Pat. Off. . |
| 106692 | 4/1984 | European Pat. Off. . |
| 2840463 | 3/1980 | Fed. Rep. of Germany . |
| 667781 | 8/1966 | South Africa . |

OTHER PUBLICATIONS

Johnson, R. E. et al, "Formulation of Hard Surface Spray Cleaners", *Detergents & Specialties,* Jun. 1969, pp. 28–32 and 56.

*Primary Examiner*—Prince E. Willis

*Attorney, Agent, or Firm*—James B. Guffey; Michael F. Campbell

[57] ABSTRACT

Novel liquid hard surface cleaning compositions are provided in the form of a homogeneous aqueous solution which comprises a glycoside surfactant, a water miscible organic solvent, a water soluble detergent builder and water and which effectively cleans soiled hard surfaces without rinsing and without leaving an objectionable residual film on such surfaces after cleaning.

12 Claims, No Drawings

METHOD AND COMPOSITIONS FOR HARD SURFACE CLEANING

BACKGROUND OF THE INVENTION

The present invention relates to aqueous liquid detergent compositions and to the use of same for the cleansing of soiled hard surfaces such as appliance cabinets or housings, walls, windows and the like.

Alkyl glycoside materials such as, for example, higher alkyl monoglycosides and higher alkyl polyglycosides are known materials; are known, at least in certain circumstances, to function as nonionic surfactants; and have been suggested as being suitable for use in certain specially formulated detergent compositions. See in this regard, for example, Published European Patent Application Nos. 0070074; 0070075; 0070076; and 0070077, all of which published on Jan. 19, 1983 as well as Published European Patent Application Nos. 0075994; 0075995; and 0075996 which published on Apr. 6, 1983.

A relatively specialized category of cleaning composition of interest to the art is one which is often referred to as a liquid detergent hard surface cleaning composition and which is specifically designed or formulated such that it can be applied to a soiled hard surface of interest (e.g., glass, painted walls, woodwork, etc.) and removed therefrom (for example as by wiping with a dry or damp cloth) without a subsequent rinsing operation and without leaving a significant or unsightly residual film upon the surface after cleaning. Thus, for example, in Published South African Patent Application No. 666,781 there is described a hard surface cleaner composition which comprises from 1–10% of an anionic surfactant (e.g., alkyl sulfate or alkyl aryl sulphonate) or a nonionic surfactant (e.g., an ethylene oxide condensate of a fatty alcohol or of an alkyl phenol) and at least 20% of a 1:1 to 4:1 ratio mixture of an alkali metal (or ammonium) borate and sodium carbonate and which, at a 1% concentration in water, has a pH of at least 9.6.

On the other hand, U.S. Pat. No. 3,591,510 to William Edward Zenk (issued July 6, 1971) describes certain liquid hard surface cleaning compositions consisting essentially of from about 0.25 to 4% of certain selected anionic or zwitterionic detergents; from about 0.5 to about 6% of certain water soluble builder components; from about 1 to about 10% of certain selected organic solvents or solvent mixtures; and the balance being water.

In a recent journal article, namely "A Greasy Soil Hard Surface Cleaning Test" by Morris A. Johnson, JAOCS, Vol. 61, No. 4, pages 810–813 (April 1984), a series of commercially available solvent-based and water-based cleaners were tested for greasy soil removal effectiveness at various dilution ratios.

Hard surface cleaning formulations are also discussed in "Formulation of Hard Surface Spray Cleaners" by R. E. Johnson and E. T. Clayton, detergents and specialties, June 1969, pages 28–32 and 56. Formulations discussed in such article included (a) one which was composed of 1 weight percent of a nonionic surfactant (linear alcohol ethoxylate), 2.5 weight percent of anhydrous tetrapotassium pyrophosphate (builder), 5 weight percent of ethylene glycol monobutyl ether (solvent) and the balance water and (b) another which was the same as the former except that the indicated nonionic surfactant was replaced with a corresponding amount of a linear alkylbenzenesulfonate anionic surfactant. In said article, it is noted that the aforementioned nonionic surfactant-based formulation exhibited slightly more filming (i.e., being given a "moderate" film rating) than its corresponding anionic surfactant-based counter-part (which obtained a "moderate-good" film rating).

SUMMARY OF THE INVENTION

It has now been discovered that the use of nonionic glycoside surfactants in certain hard surface liquid cleaning compositions provides compositions which have excellent cleaning characteristics and which also have an unexpectedly and/or surprisingly low propensity to deposit or leave an undesirable residual film upon hard surfaces cleaned therewith, even in the absence of a separate rinsing step or operation. Accordingly, the present invention, in one of its aspects, is a liquid detergent composition which comprises:

(a) a nonionic surfactant component, at least about 10 (preferably at least about 25, more preferably at least about 50 and more preferably still at least about 75) weight percent of which (on a total nonionic surfactant component weight basis) is a glycoside surfactant, said nonionic surfactant component typically constituting from about 0.1 to about 50 weight percent of the total weight of said detergent composition;

(b) a water miscible organic solvent, typically in an amount of from about 0.1 to about 50 weight percent on a total detergent composition weight basis;

(c) a water soluble detergent builder, typically in an amount of from about 0.1 to about 50 weight percent on a total detergent composition weight basis; and (d) water, typically in the range of from about 10 to about 99.7 weight percent on a total detergent composition weight basis.

The detergent composition of the present invention can, if desired, suitably take the form of a dilutable liquid concentrate for the purposes of its convenient and economical initial manufacturing or formulation operations, transport or distribution, and/or marketing and can then be subsequently diluted (e.g., by the final distributor or the ultimate user) with water prior to its ultimate use for hard surface cleaning purposes.

In their aforementioned concentrated form, the compositions of the present invention will typically comprise, on a total concentrate composition weight basis:

a. from about 5 to about 50 (preferably from about 5 to about 30) weight percent of the aforementioned nonionic surfactant component;

b. from about 10 to about 50 (preferably from about 10 to about 30) weight percent of the water miscible organic solvent;

c. from about 10 to about 50 (preferably from about 10 to about 30) weight percent of the water soluble detergent builder; and d. from about 10 to about 75 (preferably from about 20 to about 60 and most preferably from about 30 or 40 to about 50 or 55) weight percent water.

On the other hand, the compositions of the present invention in their diluted for ultimate hand surface cleaning purpose form will typically comprise, on a total diluted composition weight basis:

a. from about 0.1 to about 10 (preferably from about 1 to about 5) weight percent of the above-identified nonionic surfactant component;

b. from about 0.1 to about 10 (preferably from about 1 to about 5) weight percent of said water miscible organic solvent;

c. from about 0.1 to about 10 (preferably from about 1 to about 5) weight percent of said water soluble detergent builder; and d. from about 60 to about 99.7 (preferably from about 60 to about 97) weight percent water.

In another of its broad aspects, the present invention is also represented by a method for cleaning a soiled hard surface by the application thereto and the subsequent removal therefrom of an effective amount of the above-described, diluted-form hard surface cleaning composition of the instant invention.

DETAILED DESCRIPTION OF THE INVENTION

Glycoside surfactants suitable for use as a significant proportion (e.g. at least about 10 weight percent, preferably at least about 25 weight percent, more preferably at least about 50 weight percent, even more preferably at least about 75 weight percent and most preferably constituting essentially all) of the nonionic surfactant component of the present invention include those of the formula:

$$RO(R'O)_y(Z)_x \qquad \text{I}$$

wherein R is a monovalent organic radical (e.g., a monovalent saturated aliphatic, unsaturated aliphatic or aromatic radical such as alkyl, hydroxyalkyl, alkenyl, hydroxyalkenyl aryl, alkylaryl, hydroxyalkylaryl, arylalkyl, alkenylaryl, arylalkenyl, etc.) containing from about 6 to about 30 (preferably from about 8 to about 18 and more preferably from about 9 to about 13) carbon atoms; R' is a divalent hydrocarbon radical containing from 2 to about 4 carbon atoms such as ethylene, propylene or butylene (most preferably, the unit $(R'O)_y$ represents repeating units of ethylene oxide, propylene oxide and/or random or block combinations thereof); y is a number having an average value of from 0 to about 12; Z represents a moiety derived from a reducing saccharide containing 5 or 6 carbon atoms (most preferably a glucose unit); and x is a number having an average value of from 1 to about 10 (most preferably from 1 to about 3).

Glycoside surfactants of the sort mentioned above, and various preferred subgenera thereof, are fully discussed in U.S. Pat. No. 4,483,779 to Llenado et al. (issued Nov. 20, 1984), the discussion and description of which are hereby incorporated by reference.

Nonionic glycoside surfactants of particular interest for use in the practice of the present invention preferably have a hydrophilic-lipophilic balance (HLB) in the range of from about 10 to about 18 and most preferably in the range of from about 12 to about 14.

As is implied above, conventional nonionic surfactants different from the above-described glycoside type can, if desired, optionally be employed in conjunction with (i.e., as a nonionic cosurfactant with) the aforementioned glycoside surfactants so long as the amount of such nonionic cosurfactant is controlled to a sufficiently low level so as to avoid causing the resulting formulation to have an unacceptable propensity to leave a visually detectable (or unacceptable) residual film following the use of same, in diluted form, in hard surface cleaning applications. Surprisingly, it has been found that even conventional nonionic cosurfactants which by themselves have an unacceptably high propensity to leave a visually unacceptable residual film when used as the sole nonionic surfactant in hard surface cleaning compositions can, when used in conjunction with glycoside surfactants in accordance with the present invention, constitute as much as about 90 weight percent (preferably about 75 percent or less and most preferably about 50 percent or less) of the total weight of the nonionic surfactant component without imparting unacceptably high residual film-forming properties to the resulting hard surface cleaning composition of interest.

Examples of conventional nonionic surfactants suitable for use as optional nonionic cosurfactants in the fashion set forth above include:

(1) The polyethylene oxide condensates of alkyl phenols. These compounds include the condensation products of alkyl phenols having an alkyl group containing from about 6 to 12 carbon atoms in either a straight chain or branched chain configuration with ethylene oxide, said ethylene oxide being present in an amount equal to 5 to 25 moles of ethylene oxide per mole of alkyl phenol.

(2) The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms.

Preferably, the aforementioned optional nonionic cosurfactants have an HLB of from about 5 to about 17.

In a similar fashion, conventional anionic surfactants can also be optionally included in the hard surface cleaning compositions of the present invention so long as the amount and nature of the anionic surfactant so employed does not serve to impart unacceptable residual film forming properties to the resulting hard surface cleaning composition.

Water miscible organic solvents suitable for use in the compositions of the present invention include alkylene glycols and/or ethers thereof such as, for example, ethylene glycol mono-n-butyl ether, ethylene glycol monomethyl ether, ethylene glycol monoethyl ether, ethylene glycol mono-n-hexyl ether, propylene glycol monomethyl ether, propylene glycol monoethyl ether, isopropylene glycol monoethyl or monopropyl or monobutyl ether, etc; polyalkylene glycols and/or ethers thereof such as, for example, diethylene glycol monoethyl or monopropyl or monobutyl ether, di- or tripropylene glycol monomethyl ether, di- or tripropylene glycol monoethyl ether, etc.; t-butyl alcohol; tetrahydrofurfuryl alcohol; N-methyl-2-pyrrolidone; and the like.

Water soluble detergent builders suitable for use herein include the various water soluble alkali metal, ammonium or substituted ammonium phosphates, polyphosphates, phosphonates, polyphosphonates, carbonates, silicates, borates, polyhydroxysulfonates, polyacetates, carboxylates, and polycarboxylates. Preferred are the alkali metal, especially sodium, salts of the above.

Specific examples of suitable water soluble inorganic phosphate builders are sodium and potassium tripolyphosphate, pyrophosphate, polymeric metaphosphates having a degree of polymerization of from about 6 to 21, and orthophosphate. Examples of polyphosphonate builders are the sodium and potassium salts of ethylene-1,1-diphosphonic acid, the sodium and potassium salts of ethane-1,1,2-triphosphonic acid.

Examples of suitable water soluble nonphosphorus, inorganic builders for use herein include sodium and potassium carbonate, bicarbonate, sesquicarbonate, tetraborate decahydrate, and silicate having a molar ratio of $SiO_2$ to alkali metal oxide of from about 0.5 to about 4.0, preferably from about 1.0 to about 2.4.

Water soluble, nonphosphorus organic builders useful herein also include the various alkali metal, ammonium and substituted ammonium polyacetates, carboxylates, polycarboxylates and polyhydroxysulfonates. Examples of polyacetate and polycarboxylate builders are the sodium, potassium, lithium, ammonium and substituted ammonium salts of ethylenediamine tetraacetic acid, nitrilotriacetic acid, oxydisuccinic acid, mellitic acid, benzene polycarboxylic acids, and citric acid.

Polycarboxylate builders suitable for use herein also include those set forth in U.S. Pat. No. 3,308,067, Diehl, issued Mar. 7, 1967 incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid.

Other builders include the carboxylated carbohydrates of U.S. Pat. No. 3,723,322 Diehl incorporated herein by reference.

Other builders useful herein are sodium and potassium carboxymethyloxymalonate, carboxymethyloxysuccinate, cis-cyclohexanehexacarboxylate, cis-cyclopentanetetracarboxylate, phloroglucinol trisulfonate, water-soluble polyacrylates (having molecular weights of from about 2,000 to about 200,000 for example), and the copolymers of maleic anhydride with vinyl methyl ether or ethylene.

Other suitable polycarboxylates for use herein are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both incorporated herein by reference.

Other detergency builder materials useful herein are the "seeded builder" compositions disclosed in Belgian Pat. No. 798,856, issued Oct. 29, 1973, incorporated herein by reference. Specific examples of such seeded builder mixtures are: 3:1 wt. mixtures of sodium carbonate and calcium carbonate having 5 micron particle diameter; 2.7:1 wt. mixtures of sodium sesquicarbonate and calcium carbonate having a particle diameter of 0.5 microns; 20:1 wt. mixtures of sodium sesquicarbonate and calcium hydroxide having a particle diameter of 0.01 micron; and a 3:3:1 wt. mixture of sodium carbonate, sodium aluminate and calcium oxide having a particle diameter of 5 microns.

The liquid hard surface cleaning compositions of the present invention can, if desired in a given instance, optionally include (typically in relatively minor proportions), one or more of the various known types of supplemental ingredients or additives such as, for example, hydrotropes (e.g., water soluble salts of low molecular weight organic acids such as the sodium or potassium salts of toluene-, benzene-, or cumene sulfonic acid, sodium or potassium sulfosuccinate, etc.); perfumes; dyes or colorants; thickeners and/or soil suspensing agents (e.g. carboxymethyl cellulose, sodium polyacrylate, polyethylene glycols having molecular weights of from about 400 to about 100,000); deodorizers; ammonia; germicides; antioxidants; aerosol propellants; and the like.

In the preparation of the liquid hard surface cleaning compositions of the present invention, there is no criticality associated with the order of ingredient addition or the technique employed in manufacturing or formulating same and such can therefore be accomplished in any fashion that may be convenient or expedient under the circumstances to provide the subject composition of interest in the form of a stable, homogeneous aqueous solution thereof. As a general rule, however, it will typically be convenient to first admix the water and the water miscible organic solvent together and to thereafter add thereto (and dissolve therein) the remainder of the ingredients to be employed within the subject liquid hard surface cleaning composition.

As has been noted above, the hard surface cleaning compositions of the present invention, if desired, can suitably be initially formulated, transported, distributed and/or marketed in the form of a dilutable aqueous concentrate composition and, in such event, can be diluted to the ultimately desired, end-use active ingredient strength by the eventual end-user or by a distributor at the retail or wholesale level. Alternatively, the liquid hard surface cleaning compositions hereof can also suitably be initially and directly manufactured or formulated, transported, marketed and used or consumed in its pre-diluted, ready-to-use form as previously described in accordance with the present invention.

The above-described hard surface cleaning compositions provide efficient and effective cleaning of soiled hard surfaces (such as, for example, glass, painted walls, stove tops, woodwork, ceramic tile, appliance housings, etc.) without rinsing and without leaving an objectionable residual film upon such surfaces after cleaning.

In evaluating the relative cleaning effectiveness of the subject cleaning compositions, it is convenient to employ a Gardner Washability Apparatus (using a standard soil tile and at standard pressure and sponge stroke settings), to determine or quantify the cleaning efficiency of a given cleaning composition of interest. In determining the cleaning efficiency, reflectance values are determined using a Gardner Lab Scan Reflectometer for each of the following: a clean unsoiled panel, a soiled panel and a soiled panel following Gardner Washability Apparatus scrubbing. Such reflectance values are then employed to calculate % cleaning efficiency according to the following formula:

$$\% \text{ cleaning efficiency} = \frac{Rw - Rs}{Ro - Rs} \times 100\%$$

wherein:

Rw=Reflectance of the washed tile or panel

Rs=Reflectance of the soiled tile or panel, and

Ro=Reflectance of the clean, unsoiled tile or panel.

The propensity of a given hard surface cleaning composition of interest to leave an undesired residual film upon a surface following cleaning (i.e., spray on-wipe off with no rinsing) therewith is conveniently determined by applying 10 drops of the cleaning formulation of interest upon the surface of a 4"×4" black ceramic tile; wiping dry using 20 strokes with an adsorbent paper towel; and measuring the gloss of the tile surface using a Glossgard II Glossmeter. The gloss reading of the black tile surface is determined both before and after application (and wiping off) of the cleaning formulation of interest. The difference in gloss reading as between the before treatment reading and the after treatment reading is determined and is recorded as "% Gloss Reduction".

Filming propensity of various cleaning formulations of interest can also be evaluated visually by visually inspecting the aforementioned black ceramic tile following application thereto (and removal or wiping therefrom) of the cleaning formulation and visually categorizing the degree of filming propensity as either "heavy", "moderate", "light", "trace" or "no filming" or as being at borderline locations in between two of the aforestated categories.

The present invention is further illustrated and understood by reference to the following examples thereof in which all parts and percentages are on a weight basis unless otherwise indicated.

EXAMPLE 1

In this example, a liquid hard surface cleaning composition, Example 1, is prepared by formulating a homogeneous aqueous solution containing:

a. 2 parts by weight of a glycoside surfactant of the formula: RO $(R'O)_y(Z)_x$ wherein RO represents the residue of a mixture of fatty alcohols predominantly composed of $C_9$ to $C_{11}$ fatty alcohols, y is zero, Z is the residue of a glucose unit; and x has an average value of 1.3;

b. 2.5 parts by weight of ethylene diamine tetraacetic acid (tetra sodium salt form) as a water soluble builder;

c. 5 parts by weight of ethylene glycol monobutyl ether as a water miscible organic solvent; and d. 90.5 parts by weight water.

For comparative purposes, a second formulation (Control 1) is prepared which corresponds to that of Example 1 above except that 2 parts by weight of an ethoxylated $C_{12}$–$C_{15}$ mixed fatty alcohol nonionic surfactant (7 moles ethylene oxide per mole of fatty alcohol) is used in place of the glycoside surfactant.

Each of the resulting formulations are tested for % Cleaning Effeciency and residual filming propensity in according with the test procedures set forth herein-above. The results of such testing are summarized in Table I below.

TABLE I

| Sample | % Gloss Reduction | Visual Film Rating | % Cleaning Efficiency: Full Strength (25 ml, 10 cycle) | % Cleaning Efficiency: 1:9 Dilution (200 ml, 50 cycle) |
|---|---|---|---|---|
| Example 1 | 4.2% | Trace-Light | 62.2 | 64.5 |
| Control 1 | 40.7% | Moderate-Heavy | 61.8 | 63.9 |

As can be seen, the composition of Example 1 exhibits cleaning efficiency comparable to that of Control 1 but at the same time exhibits a noteworthy and dramatically reduced propensity toward residual film formation.

EXAMPLES 2–6

The procedure of Example 1 above is repeated for the various hard surface cleaning formulations set forth in Table II below. The % Gloss Reduction and Visual Film Rating results for the various formulations are also summarized in Table II below.

TABLE II

| Ingredients[4] | Example 2 | Example 3 | Example 4 | Example 5 | Example 6 | Control 2 |
|---|---|---|---|---|---|---|
| FORMULATION | | | | | | |
| Glycoside Surfactant[1] | 2.0 | 1.8 | 1.5 | 1.0 | 0.5 | None |
| Ethoxylated $C_{12}$–$C_{15}$ Fatty Alcohol | None | 0.2 | 0.5 | 1.0 | 1.5 | 2.0 |
| Water Soluble Builder[2] | 2.5 | 2.5 | 2.5 | 2.5 | 2.5 | 2.5 |
| Water Miscible Organic Solvent[3] | 5.0 | 5.0 | 5.0 | 5.0 | 5.0 | 5.0 |
| Water | 90.5 | 90.5 | 90.5 | 90.5 | 90.5 | 90.5 |
| Total | 100.0 | 100.0 | 100.0 | 100.0 | 100.0 | 100.0 |
| FILMING PROPERTIES | | | | | | |
| % Gloss Reduction | 0.5% | 0.9% | 2.6% | 2.8% | 10.6% | 39% |
| Visual Film Rating | No Filming-Trace | No Filming-Trace | Trace | Trace-Light | Light | Moderate-Heavy |

[1]Similar to that used in Example 1.
[2]Tetrasodium salt of ethylene diamine tetraacetic acid.
[3]Ethylene glycol monobutyl ether.
[4]Ingredients amounts stated in parts by weight.

As is seen from the results in Table II, hard surface liquid cleaning compositions of the present invention (i.e., Examples 2–6) exhibit notably reduced residual filming propensity relative to that exhibited by the comparative composition (i.e., Control 2).

While the present invention has been described and illustrated by reference to certain specific embodiments and examples thereof, such is not to be interpreted as in any way limiting the scope of the instantly claimed invention.

What is claimed is:

1. A liquid hard surface detergent composition comprising, on a total weight basis:

(a) from about 0.1 to about 50 weight percent of a nonionic surfactant component at least about 10 weight percent of which, on a total nonionic surfactant component weight basis, is a glycoside surfactant of the formula:

$$RO(R'O)_y(Z)_x \qquad \text{I}$$

wherein R is a monovalent organic radical containing from about 6 to about 30 carbon atoms; R' is a divalent hydrocarbon radical containing from 2 to about 4 carbon atoms; y is a number having an average value of from 0 to about 12; Z is a moiety derived from a reducing saccharide containing 5 or 6 carbon atoms; and x is a number having an average value of from 1 to about 10;

(b) from about 0.1 to about 50 weight percent of a water miscible organic solvent selected from the group consisting of alkylene glycol ether solvents and polyalkylene glycol ether solvents;
(c) from about 0.1 to about 50 weight percent of a water soluble detergent builder; and
(d) from about 10 to about 99.7 weight percent water.

2. The liquid detergent composition of claim 1 in the form of a dilutable liquid concentrate which comprises, on a total weight basis;
(a) from about 5 to about 50 weight percent of the nonionic surfactant component;
(b) from about 10 to about 50 weight percent of the water miscible organic solvent;
(c) from about 10 to about 50 weight percent of the water soluble detergent builder; and
(d) from about 10 to about 75 weight percent water.

3. The dilutable liquid detergent concentrate composition of claim 2 which comprises, on a total weight basis:
(a) from about 5 to about 30 weight percent of the nonionic surfactant component;
(b) from about 10 to about 30 weight percent of the water miscible organic solvent;
(c) from about 10 to about 30 weight percent of the water soluble detergent builder; and
(d) from about 10 to about 75 weight percent water.

4. The liquid detergent composition of claim 1 in the form of a ready to use hard surface cleaner which comprises, on a total weight basis:
(a) from about 0.1 to about 10 weight percent of the nonionic surfactant component;
(b) from about 0.1 to about 10 weight percent of the water miscible organic solvent;
(c) from about 0.1 to about 10 weight percent of the water soluble detergent builder; and
(d) from about 60 to about 99.7 weight percent water.

5. The composition of claim 1 wherein, in the glycoside surfactant of the Formula I, R is an alkyl group containing from about 9 to about 13 carbon atoms; y is zero; Z is derived from glucose; and x has an average value of from 1 to about 3.

6. The composition of claim 1 wherein the glycoside surfactant constitutes at least about 50 weight percent of the nonionic surfactant component.

7. The composition of claim 1 wherein the glycoside surfactant constitutes at least about 75 weight percent of the nonionic surfactant component.

8. The composition of claim 1 wherein the nonionic surfactant component consists essentially of said glycoside surfactant.

9. The liquid detergent composition of claim 1 wherein the water miscible organic solvent is selected from the group consisting of ethylene glycol mono-n-butyl ether; ethylene glycol monomethyl ether; ethylene glycol monoethyl ether; ethylene glycol mono-n-hexyl ether; propylene glycol monomethyl ether; propylene glycol monoethyl ether; isopropylene glycol monoethyl or monopropyl or monobutyl ether; diethylene glycol monoethyl or monopropyl or monobutyl ether, di- or tri-propylene glycol monomethyl ether; or di- or tripropylene glycol monoethyl ether.

10. The liquid detergent composition of claim 1 wherein the water miscible organic solvent is ethylene glycol monobutyl ether.

11. The liquid detergent composition of claim 10 wherein the water soluble builder is the tetrasodium salt of ethylene diamine tetraacetic acid.

12. A method for cleaning a soiled hard surface which comprises applying thereto and subsequently removing therefrom an effective amount of a liquid detergent composition comprising, on a total weight basis;
(a) from about 0.1 to about 10 weight percent of a nonionic surfactant component at least about 10 weight percent of which, on a total nonionic surfactant component weight basis, is a glycoside surfactant corresponding to the formula:

$$RO(R'O)_y(Z)_x \qquad \text{I}$$

wherein R is a monovalent organic radical containing from about 6 to about 30 carbon atoms; R′ is a divalent hydrocarbon radical containing from 2 to about 4 carbon atoms; y is a number having an average value of from 0 to about 12; Z is a moiety derived from a reducing saccharide containing 5 or 6 carbon atoms; and x is a number having an average value of from 1 to about 10;
(b) from about 0.1 to about 10 weight percent of a water miscible organic solvent selected from the group consisting of alkylene glycol ether solvents and polyalkylene glycol ether solvents;
(c) from about 0.1 to about 10 weight percent of a water soluble detergent builder; and
(d) from about 60 to about 99.7 weight percent water.

* * * * *